United States Patent [19]

Young

[11] 4,227,473

[45] Oct. 14, 1980

[54] CAN EDGE RIDING CAN OPENER

[76] Inventor: Claude A. Young, 126 N. Kensington St., LaGrange, Ill. 60525

[21] Appl. No.: 18,593

[22] Filed: Mar. 8, 1979

Related U.S. Application Data

[63] Continuation-in-part of Ser. No. 855,552, Nov. 29, 1977, abandoned.

[51] Int. Cl.[3] ..... B21D 39/03

[52] U.S. Cl. ..... 113/1 K; 113/120 BB

[58] Field of Search ..... 113/1 K, 120 BB, 120 Y, 113/120 DD, 120 M, 120 R, 121 R; 29/427

[56] References Cited

U.S. PATENT DOCUMENTS

| | | | |
|---|---|---|---|
| 2,119,135 | 5/1938 | Link | 113/1 K |
| 2,196,182 | 4/1940 | Arnesen | 113/1 K |
| 2,255,641 | 9/1941 | Arnesen | 113/1 K |
| 2,845,887 | 8/1958 | Krodoska | 113/1 K |
| 3,006,303 | 10/1961 | Young | 113/1 K |
| 3,366,085 | 10/1965 | Young | 113/1 K |
| 3,734,043 | 5/1973 | Rosenbloom | 113/120 BB |
| 3,890,912 | 6/1975 | Young | 113/1 K |
| 3,922,984 | 12/1975 | Zwideveld | 113/120 BB |

*Primary Examiner*—Leon Gilden

*Attorney, Agent, or Firm*—McWilliams, Mann & Zummer

[57] ABSTRACT

A can opening device for opening cans by unfolding the can rim comprising a clamping disc, a traction disc, and a wedge disc assembled in coaxial relation about an operating axis that is to be disposed crosswise of the can side wall, in which the assembly traction disc has its periphery knurled to ride on the can rim and the wedge disc has formed about its rim a ledge that is shaped about its inner margin to define a circular working edge having a wedging rim at the side surface of the ledge, for application to the can ridge for unfolding the can end and body rims as the device rides about the can ridge. The clamping disc is formed with a smoothly contoured rim portion for clamping against the inside of the can ridge to hold the device in its operative position. The discs are rotated in the illustrated embodiments by a crank arm to actuate the device for providing a smooth camming action on the can ridge by application thereto of the circular working edge which moves its parts into unfolded relation for ready removal of the can end from the can without having to cut the can end or side wall in any way.

22 Claims, 25 Drawing Figures

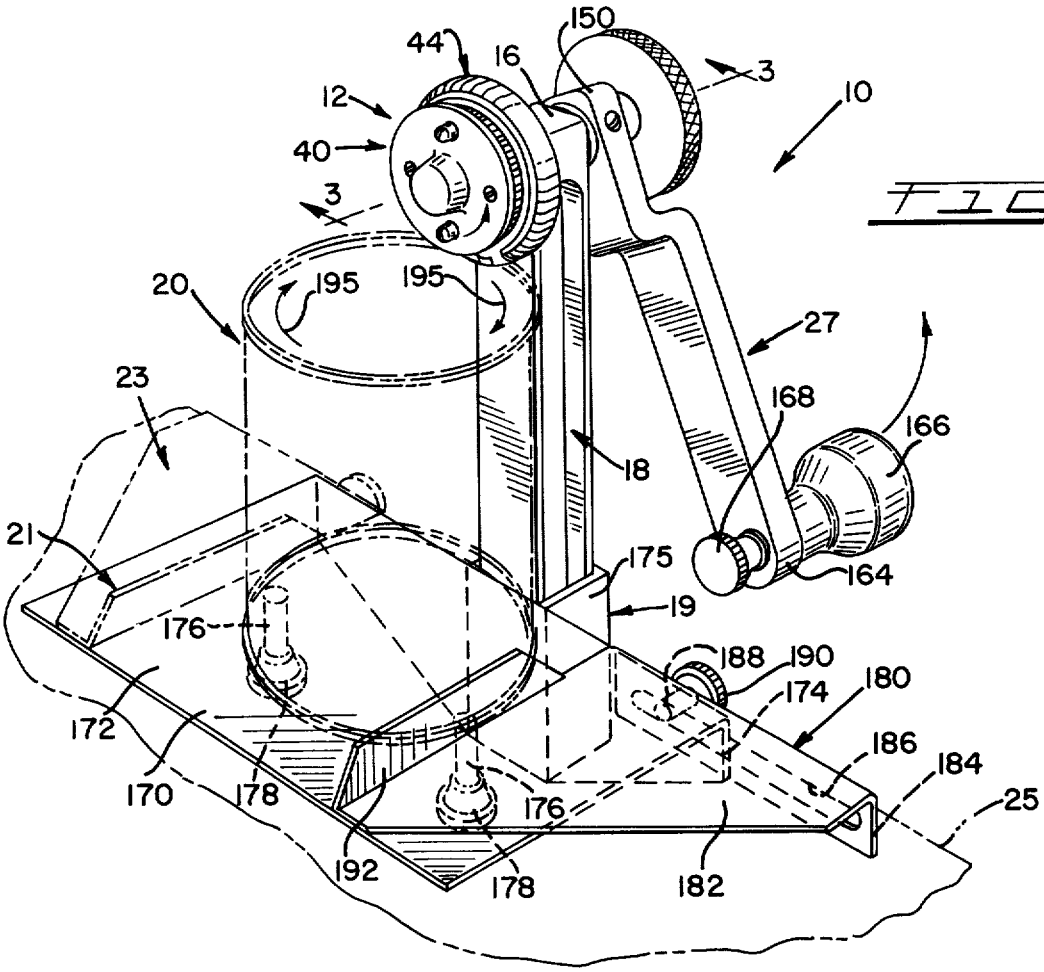
FIG. 1
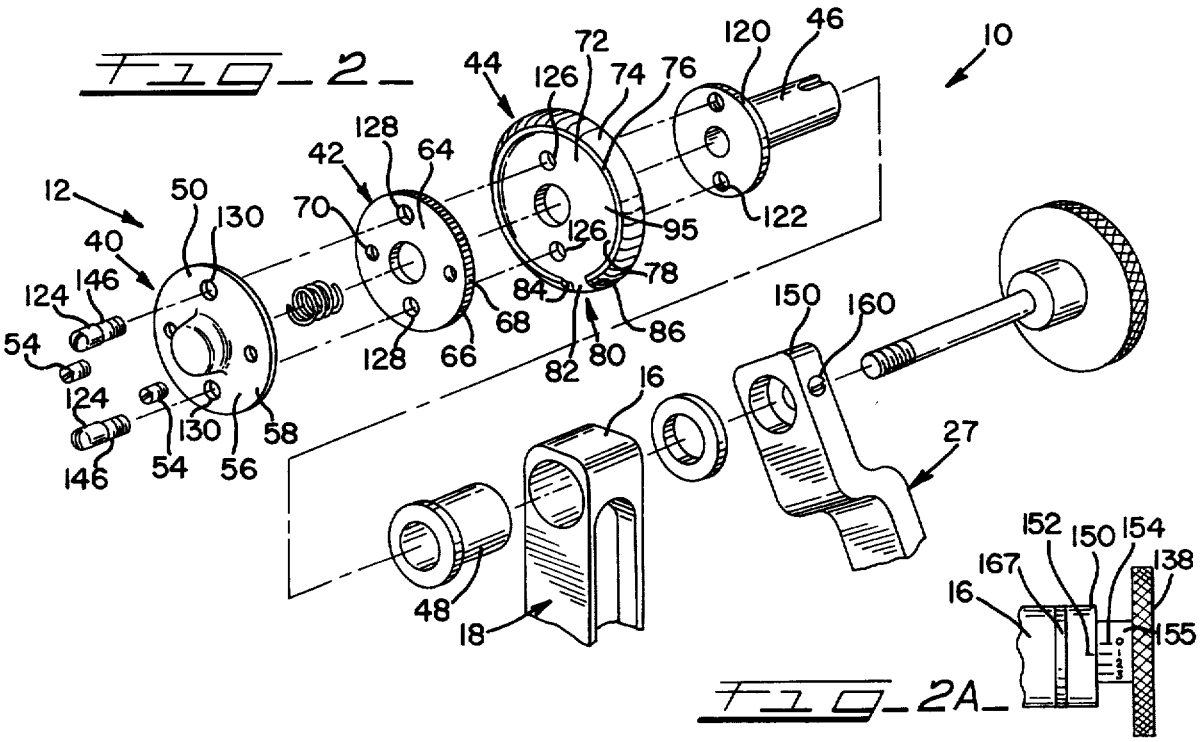
FIG. 2
FIG. 2A

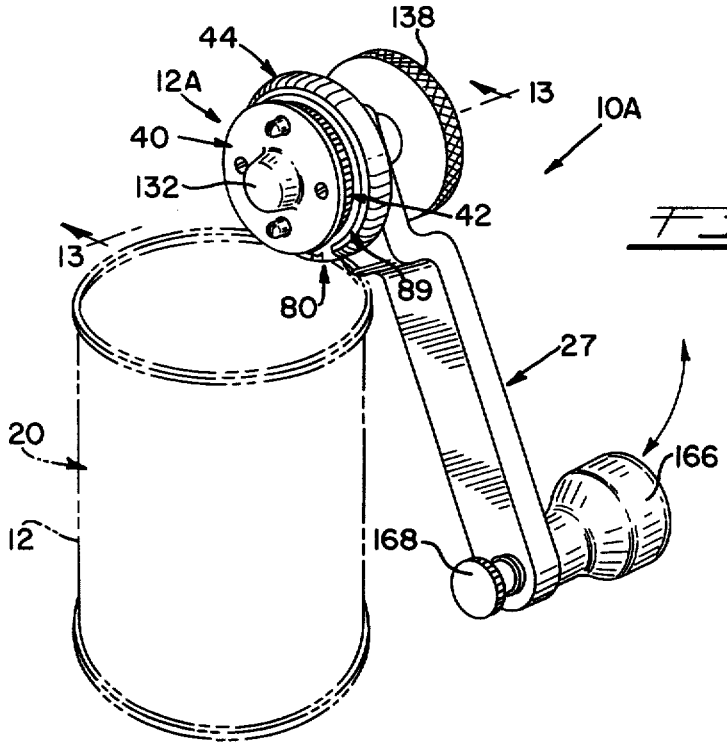
FIG. 12
FIG. 13
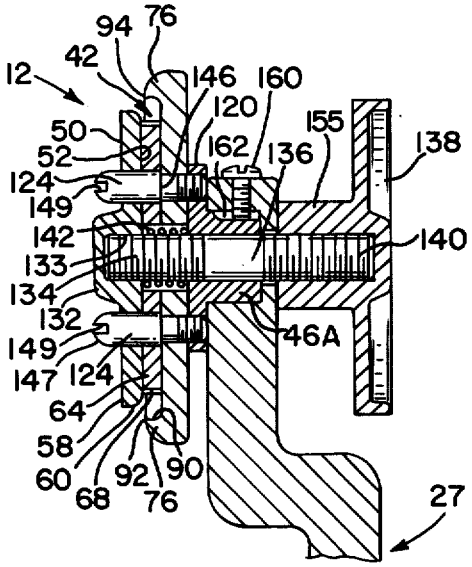
FIG. 14
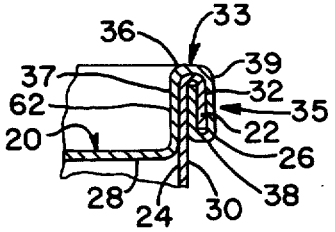

CAN EDGE RIDING CAN OPENER

This application is a continuation-in-part of my copending application Ser. No. 855,552, filed Nov. 29, 1977 now abandoned in favor of the present application.

This invention relates to a can opening device for opening cans, and more particularly, to can opening devices for opening the can without cutting or tearing the can end or side wall.

My U.S. Pat. Nos. 3,006,303, 3,344,763, and 3,890,912 disclose can opening arrangements that eliminate the need to cut or tear cans to get them open, together with the consequent formation of metal fragments that drop into the food. Instead, the can is opened by unfolding the rim of the can where the can end and can side wall are joined together. Thus, the can seam about the rim of the can is unfolded or deseamed.

The common metal container, commonly known as a "can", is made up of a tubular metal body that forms the can side wall, and two closure or end portions that form the respective ends of the can. As is well known, such cans may be cylindrical or round in shape in the case of cans of the type in which vegetables and fruits and the like are packaged, or they may be other than round in shape in the case of containers for sardines, hams, and the like. These elements or component parts of the can are secured together by placing together the rim of a can end or closure and the rim of a can body or side wall, and bending such rims over against the outside surface of the can body or side wall in such a manner that a seam in the form of a ridge is formed at the end of the can which projects outwardly from the end of the can in parallelism with the can body. The folding action involved is such that a portion of the can end or closure rim is interposed between the can body or side wall outer surface and the can body or side wall rim. This, together with an appropriate seal interposed between the rims, provides a complete packaging seal for containers of this type.

The inventions of my said patents are concerned with the opening or deseaming of such cans by separating the rim of the can end of closure from the rim of the can body or side wall, this is, by undoing the assembly process, whereby the can may be opened without penetrating it or otherwise exposing the can contents to contamination prior to removal of the can end. In the arrangement of my U.S. Pat. No. 3,890,912, a hand tool for opening cans is provided in the form of a lever having a hand grip portion at one end of same and a blade portion at its other end, with the blade portion defining a convexly rounded working edge that is offset to one side of the lever, and that is grooved longitudinally of the lever for application against the side of the can and under the can ridge at the end of the can that is to be opened. The lever also has a fulcrum member located adjacent its blade portion and projecting from the side of the lever from which the blade portion working edge is offset, for application on top of the can ridge to be unfolded.

With the lever positioned to dispose the working edge under the can ridge at the end of the can that is to be opened and the fulcrum disposed over such can ridge, the lever hand grip portion is pressed in the direction of the can (or downwardly, assuming the can is on a horizontal supporting surface), to swing the composite flange structure that forms the can ridge outwardly of and up to its angular relation with respect to the can side wall at one location on the can side wall. This operation is repeated in a step by step manner, with the can being turned or rotated as needed after application of the hand tool to the can. The can ridge may be completely unfolded in this manner and the hand tool employed as disclosed in said patent to pry the lid free of the can side wall, which leaves the can lid in a shape suitable for re-application to the can for closing purposes.

A principal object of this invention is to provide in can opener or deseamer of the type that unfolds the can ridge in question, an arrangement in which the can ridge is acted on by a wedge type working edge, in which the opener components ride about the can ridge in a rotary manner and use it both as a guide and a traction base in effecting a controlled unfolding of the can end rim and the can side wall rim involved.

Another principal object of the invention is to provide a can opener of the type indicated in which the can ridge is smoothly unfolded by a rotary mechanical action involving a mechanism that rides on the can ridge, with the can supported upright on a suitable stationary surface, which mechanism includes a rotating wedge disc having a circular working edge and an associated convex wedging rim that effect a smooth camming of the can ridge forming rim components to full unfolded position the desired amount about the can circumference, and with minimum rotary action being required.

Another important object of the invention is to provide a can ridge unfolding type opener that provides for ready and accurate application to the can, and quick, easy and reliable operation in effecting the unfolding action involved.

Other objects of the invention are to provide an unfolding type can opener or deseamer that is adapted for both commercial and home use, that is composed of few and simple parts, that is readily understood and operated by mechanically unskilled persons, and that is economical of manufacture, applicable to most conventional types of cans, and long lived in operation.

In accordance with the invention, the can opening device comprises a clamping disc, a traction disc, and a wedge disc assembled in coaxial relation about an operating axis for application to the can ridge so as to ride on and about the can ridge in operation. The assembly traction disc has its periphery knurled to ride on the can ridge, and the wedge disc has formed about its rim, on the side of same that faces the can, a circular ledge which is shaped about its inner margin to define a circular working edge in the plane of the ledge shaped to define a circular wedging sharply angled wedging rim, on said side of the wedge disc. The clamping disc is formed with a smoothly contoured rim portion for clamping against the inside of the can ridge to hold the device in its operative position in which the rotary axis of the device extends crosswise of the can ridge on which the device rides. The discs of the device are keyed together for rotation, for instance, by a crank arm associated with the device, with the device being initially disposed on the can ridge to locate the can ridge between the clamping disc and the wedge disc so as to dispose the wedge disc ledge working rim in wedging relation between the can ridge and the can side wall. The device components are rotated to roll the wedge disc working rim upwardly against the can ridge to progressively cam the can ridge structure into an upwardly directed unfolded relation about the circumference of the can ridge to the extent needed to remove the now loosened can end.

This may be accomplished or largely accomplished by a single rotary action of the can opener operating parts about the device operating axis, with the can opener riding along the can ridge as it operates.

Other objects, uses, and advantages will be obvious or become apparent from a consideration of the following detailed description and the application drawings in which like reference numerals indicate like parts throughout the several views.

In the drawings:

FIG. 1 is a diagrammatic perspective view illustrating one embodiment of the invention arranged for commercial can opening operations, showing in phantom a can about to be opened by the device;

FIG. 2 is a diagrammatic exploded perspective view of the basic can opener assembly involved;

FIG. 2A is a fragmental plan view of the device operating handle and adjustment knob, illustrating an adjustment feature of the invention;

FIG. 12 is a view similar to that of FIG. 1, but illustrating a simplified embodiment of the invention suitable for home use;

FIG. 13 is a view similar to that of FIG. 3, taken substantially along line 13—13 of FIG. 12;

FIG. 14 is a fragmental cross-sectional view through a conventional can ridge portion, on an enlarged scale, for the purpose of illustrating the parts involved;

However, it is to be understood that the specific drawing illustrations provided are supplied primarily to comply with the requirements of the Patent Laws, and that the invention may have other embodiments that will be obvious to those skilled in the art, which are intended to be covered by the appended claims.

Figure 3:
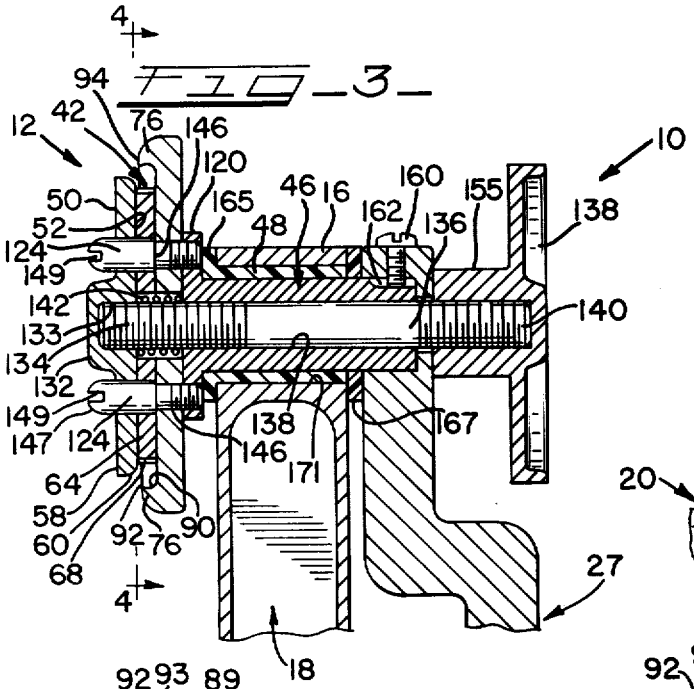
FIG. 3 is a diagrammatic fragmental vertical sectional view taken substantially along line 3—3 of FIG. 1, but somewhat enlarged.

Reference numeral 10 of FIGS. 1–3 generally indicates one embodiment of the invention while reference numeral 10A of FIG. 12 generally indicates a simplified version of the general type of opener shown in FIGS. 1–11. Reference numeral 10B of FIG. 19 generally indicates a preferred embodiment of the invention that generally improves over the embodiment of FIGS. 1–11.

The openers 10 and 10A form the subject of my said application, opener 10 generally comprising a can opener head assembly 12 journaled for rotation about a horizontal axis 14 at the upper end 16 of a mounting staff or post 18 that is slidably received in support bracket 19 that is suitably affixed to platform 21 that is in turn suitably secured to a suitable horizontal support 23, such as a table or the like, along one side edge 25 of same.

In accordance with the basic invention involved, the head assembly 12 is rotated about axis 14, in the form shown, by employing hand lever 27, to open conventional containers of the type generally indicated at 20 in the drawings. These containers are commonly known as "cans", and are conventionally sealed in the manner indicated in FIG. 14 by having the rim or flange 22 of the can body or side wall 24 and the rim or flange 26 of the can end or closure 28 placed together and bent over against the outer surface 30 of the can side wall. Ordinarily, a sealant material is applied between the rims or flanges 22 and 26 where indicated at 32, and the can end 28 is dished somewhat so that the can ridge 33 is formed by the bent together rims or flanges 22 and 26. As formed, the ridge 33, which ordinarily is present at both ends of the can, defines inner and outer circumferential side walls 37, 39 that are formed by the indicated portions of the can end or closure 28.

It will be noted that the ridge 33 exteriorily of the can side wall surface 30 is in the form of a composite flange structure generally indicated by reference numeral 35, having one end 36 of same directed outwardly and endwise of the can 20, and the other end 38 of same disposed about the can side wall or body outer surface 30 and directed toward the other end of the can.

Most cans of the familiar can type in use at the present time are sealed in the manner indicated in FIG. 14, and this is ordinarily done by machines of well known design that require no specific description. Cutting type can openers, in being used to open such containers, both penetrate the container, and form metal fragments, during the cutting operation, a significant portion of which may fall into the container contents with resultant contamination.

In accordance with this invention, the can openers 10, 10A and 10B are arranged to cooperate with the can ridge 33, and specifically with the upper or upwardly extending can ridge 33 when a can is placed upright on a supporting surface, for the purpose of deseaming or unfolding same, about the circumference of the can, in the manner indicated in the drawings, to open the can without penetrating the can, and without cutting the can components.

Figure 5:
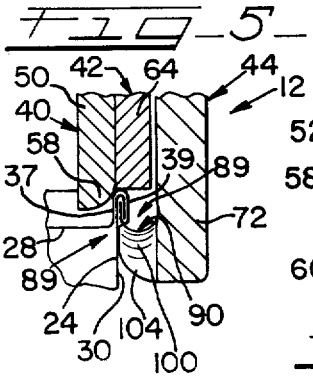
FIG. 5 is a diagrammatic sectional view taken substantially along line 5—5 of FIG. 4 illustrating the orientation of the basic can opener components to the can ridge being opened at the opener full line position of FIG. 4, immediately prior to the initial unfolding action being effected on the can ridge.
Figure 11:
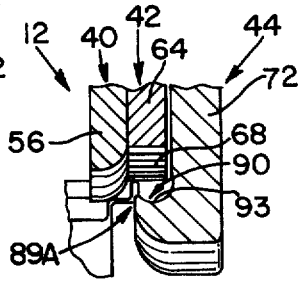
FIG. 11 is a view similar to that of FIG. 5 but at the position indicated by line 11—11.

Referring now more specifically to FIGS. 2 and 3, the can opener head assembly 12 of opener 10 comprises a clamping disc 40, a traction disc 42 and a wedge disc 44 assembled in the manner indicated in FIG. 3, for operation by hand lever 27 on application of head assembly 12 to the upwardly disposed ridge 33 of a can 20 (see FIG. 1), to unfold the can upwardly directed ridge 33 from the can sealing relation of FIGS. 5 and 14 to the unfolded relation illustrated by FIG. 11, circumferentially of ridge 33, whereby the upper can end or closure 28 may be readily removed from the can 20 to expose its contents.

In the embodiment of FIGS. 1–11, the head assembly 12 is secured to hub 46 that is in turn received in suitable antifriction sleeve 48 suitably mounted at the upper end 16 of mounting staff 18. Hub 46 extends through the staff or post 18 for keying connection to hand lever 27 whereby the head assembly 12 is rotated about axis 14.

The mounting staff 18 is slidably mounted for movement longitudinally thereof in the bracket 19. A can 20 to be opened is placed in the operating position indicated at FIG. 1 after the head assembly 12 is raised sufficiently to permit this, and the head assembly 12 is lowered to engage the upwardly extending can ridge 33 for purposes of unfolding same in accordance with the invention to permit removal of the container end closure or "lid" 28.

The clamping disc 40 of head assembly 12 comprises the disc member 50 that has the traction disc 42 suitably affixed to its side 52, as by employing suitable screws 54 applied from the other side 56 of same. The disc member 50 is proportioned to define a rim portion 58 that projects beyond the traction disc as indicated in FIG. 3, with the disc member rim portion 58 on its side 52 defining a smoothly and spherically contoured camming surface 60 for clamping engagement with the inner side wall 37 of the can ridge 33, and adjacent its end 36.

The traction disc 42 comprises disc member 64 having its periphery 66 knurled as indicated at 68 for tractional riding on the upwardly directed end 36 of the can ridge 33 when the opener is operating on the can ridge 33. Disc member 64 is formed with suitable threaded screw holes 70 for threadedly receiving the screws 54.

The wedge disc 44 is of special significance and comprises disc member 72 which has its rim portion 74 shaped to define the laterally projecting circular ledge 76 on the side 78 of same. The ledge 76 is interrupted, in accordance with the opener 10 and 10A embodiments of the invention, as at 80 to define a radial slot 82 in which the ledge end portions 84 and 86 are of special significance (see FIGS. 4A and 4B).

The ledge 76 of disc member 72 between its ends 84 and 86 defines concave circular working edge surface 90 that is concave transversely of the disc member 72 as well as in the plane of ledge 76, which merges into the marginal concavely arcuate wedging rim 92 that is in substantial coplanar relation with the side surfacing 94 of the ledge 76.

The ledge 76, its surface 90, and its wedging rim 92 are in concentric relation with the disc member 72 and about axis 14. Edge 90 is in the nature of a trough 93.

The ledge 76 of wedge disc 44 defines recess 95 in which and within which the traction disc 42 is received and aligned in the operative relation of the head 12, with the discs 42 and 44 being arranged in concentric coaxial relation about axis 14 in accordance with the invention.

The ends 84 and 86 of the wedge disc ledge 76 have a configuration of the general type employed in the working edge 17 of my above referred to U.S. Pat. No. 3,980,912 (the entire disclosure of which is incorporated herein by this reference), these being the portions of the wedge disc that initiate the unfolding action on the can ridge, and in a manner similar to that disclosed in my said U.S. Pat..No. 3,890,912.

Figure 4:
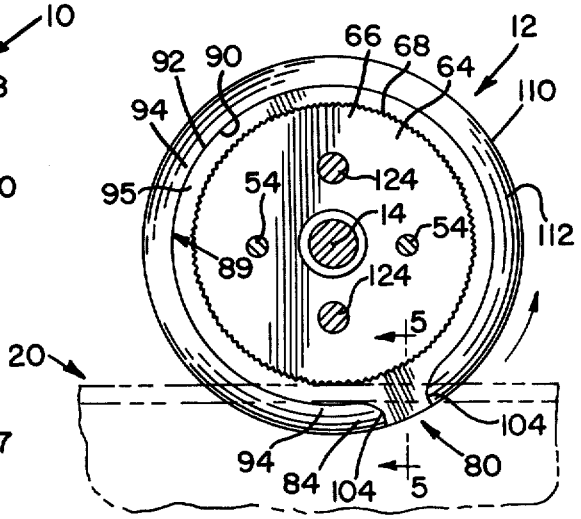
FIG. 4 is a diagrammatic view of the basic opener assembly, taken along line 4—4 of FIG. 3, and showing same applied to a can at the initial stages of operating the device, with parts shown in section.
Figure 4A:
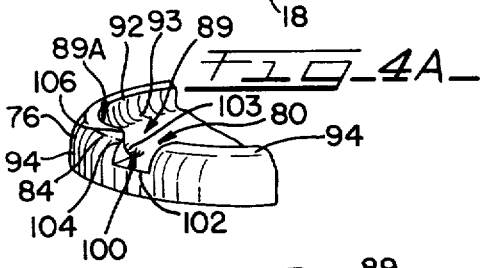
FIGS. 4A and 4B are fragmental perspective views better illustrating the respective convex working edges of the wedge disc that adapt the device for both right hand and left hand use.

Thus, at the ledge end 84, the ledge 76 defines working edge 100 that is convex in the plane of the ledge 76, but is concave transversely of the wedge disc 44, as indicated in FIG. 4A. The edge 100 extends substantially from alignment with the entry end 102 of the slot 82 and merges into the working edge surface 90, as at 103. The edge 100 at the surface 94 of ledge 76 merges into the wedging rim 104 which is convexly curved in the plane of the ledge 76 and smoothly merges into wedging rim 92 as at 106 in FIG. 4A.

Figure 4B:
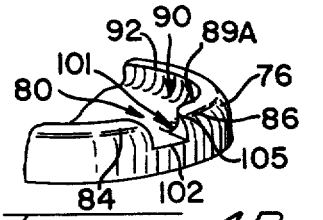

The end 86 of the ledge 76 is similarly contoured but in reverse manner, as indicated in FIG. 4B, wherein the working edge 101 is comparable to edge 100 and the wedging rim 105 is comparable to rim 104.

The ledge 76 adjacent the outer rim portion 110 of the wedge disc 44 defines spherically contoured marginal surfacing 112 that in the area of the slot 82 simplifies the formation of the desired arcuate configuration of the rims 104 and 105.

The working edges 90, 100 and 101 are thus of grooved configuration transversely of ledge 76. Working edge 100 is for right hand operation of opener 10, while working edge is for left hand operation thereof, as will be apparent from the disclosure that follows.

The working edges 90, 100 and 101 thus form a marginal grooved edging 89 with a sharply angled rimming 89A along the ledge 76 that effects the aforementioned unfolding action on the can ridge 33 that for openers 10 and 10A is indicated in FIGS. 4–11.

Another aspect of the invention is that the head assembly 12 is arranged for accommodating can ridges 33 of varient sizes (in diameter and thickness) and for clamping of the head assembly 12 in its operating position.

In the opener 10 and 10A, this arrangement comprises the hub 46 being flanged as at 120 and formed with one or more threaded openings 122 in which are threadedly mounted a corresponding number of keying guide pins 124 that extend through the discs 42 and 44 in the manner indicated in FIG. 3. Thus, the pins 124 are received through the openings 126 of the wedge disc 44, openings 128 of the traction disc 42, and openings 130 of the clamping disc 40.

The clamping disc 40 of openers 10 and 10A is formed with a boss 132 internally threaded as at 133 to fixedly receive the threaded end 134 of adjustment shaft, stud or arbor 136, which extends through the bore 138 of the hub 36 and has adjustment knob 138 threadedly mounted on its threaded end 140. Shaft 136 should be suitably fixed against removal from disc 40, as by employing jam fitting, a suitable bonding material, or the like.

Received about the shaft 136 and interposed between the clamping disc 40 and hub 46 is compression spring 142 which biases clamping disc 40 away from hub 46 and the parts secured to it, which include in the openers 10 and 10A the wedge disc 44 that is held in place against the hub flange 120 by the corner shaping of the pins 124, where indicated at 146. Pins 124 have their heads 147 of spherical contour and formed with suitable screw driver blade receiving slots 149 in the illustrated embodiments; pins 124 are in free sliding relation to clamping disc 40 and traction disc 42.

Thus, by loosening and tightening of the knob 138 on shaft 136 (which is assumed to be fixedly mounted with respect to clamping disc 40), the spacing of the clamping disc camming surface 60 from the wedge disc 44 may be varied both as an aid to mounting of the head 12 on the can ridge 33 and accommodating can ridges 33 of varient thicknesses and diameters.

The clamp, traction and wedging discs are thus mounted in coaxial relation with respect to shaft 136, and each other, with shaft 136 having its longitudinal axis define axis 14.

The opener 10 is preferably calibrated to indicate the degree of spacing of the clamping disc 40 in the fully closed position of FIG. 3, wherein the traction disc 42 is drawn against the wedging disc 44 by the threading of the knob 138 on the threaded shaft end 140. As indicated in FIG. 2A, the crank arm 27 at its upper end 150 is formed with a datum zero line 152 indicating the full take up position of FIG. 3, wherein the zero indicia line 154 formed on knob 138 is aligned therewith. The other indicia lines shown on the hub 155 of knob 138 in FIG. 2A are calibrated indicate the degree of separation of the clamping disc from its fully closed position.

In the form shown, the crank arm 27 is equipped with suitable set screw 160 which is seated in slot 162 formed in hub 46 to key the crank arm 27 to the hub 46. Crank arm 27 at its crank end 164 has hand gripping knob 166 suitably secured thereto by having a suitable pin (not shown) extending therethrough and through crank arm 27 and held in place by suitable lock nut 168. Bearing 48 is flanged as at 165 and bearing disc 167 is employed, to provide antifriction means between the staff 18, hub flange 120, and crank arm 27. Bearings 48 and 167 may be formed from Teflon or the like.

The staff or post 18 in the form shown is an elongate bar 169 proportioned for close fitting free sliding engagement within bracket 19, and defining bore 171 that receives bearing 48.

Platform 21 comprises angle plate 170 defining a planar smooth upper surfacing 172 and downwardly turned edge portion 174 to which bracket 19 is suitably affixed, as by employing welding. Bracket 19 is a channel member 175 proportioned to closely receive the staff 18, in the illustrated opener 10, while permitting free sliding movement under gravity. The plate 170 on its underside has affixed thereto a pair of spaced apart depending mounting studs 176 which pass through suitable holes formed in the support 23 for that purpose for threadedly receiving the respective threaded knobs 178 to clamp the platform 21 in operating position along and in conformity to the side edge 25 of support 23.

Further in accordance with the invention, the platform 21 is equipped with adjustably mounted can guide member 180 in the form of angle plate member 182 having angled edge portion 184 slotted as at 186 to receive threaded stud 188 that is affixed to the platform angle side edge 174. Stud 188 receives threaded knob 190 for clamping the can guide in a desired position of adjustment. The can guide 180 includes upwardly extending flange 192 that is to engage the side of the can when the opener 10 is operated, as will be described hereinafter.

Platform 21 as shown in full lines is arranged for right hand operation of head 12. For left hand operation of head 12, platform 21 on the side at the upper portion of FIG. 1 is provided with a second guide member 180 and associated parts arranged to guide the can from the upper side of FIG. 1, as indicated in outline.

In the embodiment of FIGS. 12 and 13, the opener includes a head assembly 12A that is essentially the same as assembly 12. In this embodiment of the invention, the journaling of the head assembly is dispensed with, and the head assembly 12A in the form shown is operably associated with a shortened hub 46A that is the same as the hub 46 but free of journaling in anything comparable to the staff 18. The opener 10A includes the hand crank 27 that is keyed thereto to operate assembly 12A to unfold the can ridge 33 in a manner similar to that of tool 10, except the head assembly 12A is not journaled for operation about a stationary axis coincident with the axis 14, but rather the hand crank is swung about axis 14 to move opener 10A about the can ridge 33, as will be described hereinafter.

The can opener 10 may be employed to unfold the ridge 33 of can 20 in the following manner.

Assuming that the platform 21 is mounted as shown in FIG. 1 and has the can guide 180 (full line showing) and head assembly support post or staff 18 applied thereto as indicated in FIG. 1, the can 20 to be opened is placed approximately as shown in FIG. 1 after the head assembly 12 has been raised to an out of the way position and the can guide 180 is moved to one side (toward the observer) to freely apply the can 20 in an upright position to the platform surface 172 in alignment with the head assembly 12 and its supporting post 18. The can is moved sufficiently close to the post 18 so that the head assembly 12 will rest on top of the upper can ridge 33. Crank arm 27 may then be disposed, under the action of gravity, in alignment with the post 18.

The knob 138 is then turned to permit the biasing spring 142 to separate the clamping disc 40 (and the traction disc 42 it carries) from the wedge disc 44 a sufficient amount so that the can ridge 33 at the upper end of the can 20 may be easily applied within the clamping disc and wedge disc for unfolding purposes with the traction disc 42 resting on the upper end 36 of the can ridge 33.

The knob 138 is then turned on the shaft 136 to return the zero datum line 154 of the knob 138 toward alignment with the zero datum line 152 of the crank arm 27, and to as near to that position as the components involved will allow without overstressing, after which the handle 138 is backed off to the point where the can ridge 33 will be firmly gripped between the clamping disc 40, and the wedge disc 44, with the traction disc periphery 66 resting on the upper end 36 of the can ridge 33. The end positioning of the knob 138 relative to the zero datum 152 will depend on the gauge and internal diameter of the ridge 33 for the particular can being opened. Clamping disc 40 will now engage the can ridge 33 at two spaced apart positions.

The crank arm 27 is then grasped and, assuming right hand operation of same is to be used, turned about axis 14 to position the head assembly 12 so that the slot 82 defined by wedge disc 44 is disposed approximately as indicated in FIG. 4, and thus so that the end 84 of the slot 82, and specifically its rim 104, may be brought up firmly between the can ridge end 38 and the can side surface 30 (see FIG. 5), with the can ridge 33 received behind the rim surfacing 60 of the clamp plate 40. The can guide 180 is then shifted to bring its guide flange 192 into engagement with the side of the can 20 and its knob 190 tightened to lock the can guide 180 in this position.

Figure 6:
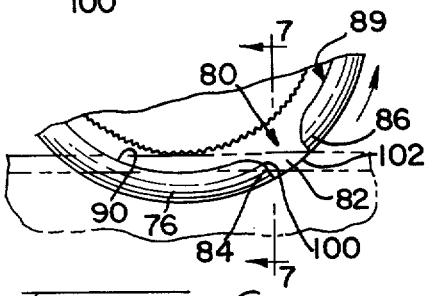
FIG. 6 is a fragmental view similar to that of FIG. 4 but showing the opener at the initial unfolding stage of the can opening operation.
Figure 8:
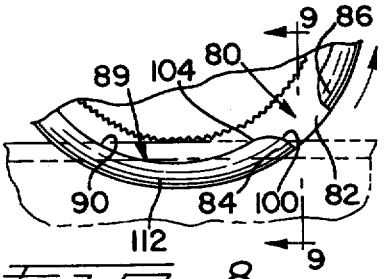
FIG. 8 is a fragmental view similar to that of FIG. 4, but illustrating the opener components at a somewhat more advanced stage of the opening procedure.
Figure 10:
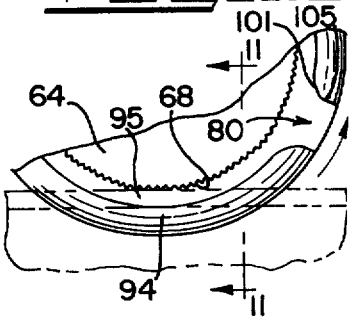
FIG. 10 is a view similar to that of FIG. 4, but illustrating the opener at a still further subsequent position of its operation.
Figure 7:
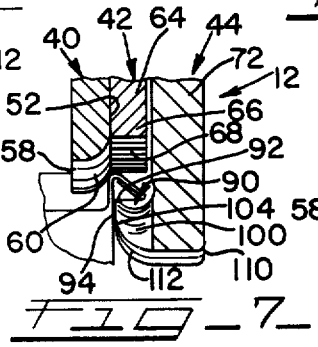
FIG. 7 is a sectional view similar to FIG. 5 but illustrating the stage of the can opener and can ridge components at the can opener position of FIG. 6.

The crank arm 27 is now swung in the same direction to move the head assembly 12 counterclockwise of FIG. 4 from the full line position of FIG. 4 which draws the working edge 100 at the ledge end 84 upwardly against the ridge end 38, to the position of FIGS. 6 and 7, which effects a swinging of the can ridge flange structure 35 at the location of the working edge 100 between the positions of FIGS. 5 and 7. During this movement, it is helpful for the operator to use his free hand to hold the can against head assembly 12.

Figure 9:
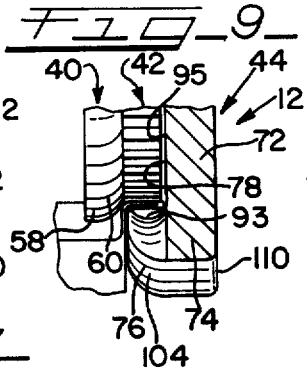
FIG. 9 is a view similar to that of FIG. 5 illustrating the status of the can opener and can ridge components involved at the position of FIG. 8.

Movement of the head assembly crank arm 27 is continued in the same direction, now moving the working edge 90 of the wedge disc into operative engagement with the now bent over ridge flange structure 35, which, as the head assembly 12 rides around the can ridge 33, bends the can ridge flange structure in a progressive manner between the positions of FIGS. 9 and 11; the end 38 of the can ridge being caught in the trough 93 defined by edge 90 and the can rotational movement effected by the rotation of traction disc 42, effecting the continuous camming action the can ridge 33 that is involved.

In this connection, since the head assembly 12 is journaled in the post 18 that is stationary during operation of the opener 10, the traction of the traction disc on the can 20 ridge 33 will turn the can 20 in question, relative to the opener, in the direction indicated by the arrows 195 shown in FIG. 1.

When the hand crank 27 has been swung in the counterclockwise direction indicated in FIGS. 4 through 10, to return the slot 82 approximately to the position of FIG. 4, there will be an interruption in the smoothly unfolded can rim components that is represented by the "gap" defined by slot 82. The can is then preferably hand rotated in a reverse direction (by the operator) an appropriate amount to bring the resulting yet unfolded interruption of the ridge flange structure back to the left hand side of FIG. 5 (beyond the wedge disc 44) and then rotational movement of the head assembly 12 is continued in the counterclockwise direction indicated to complete opening of the can.

Alternately, instead of finishing up the unfolding of the ridge 33 by the counterclockwise rotating movement of the head assembly 12 that has been indicated, the head assembly 12 can be rocked back and forth after the working edge 100 has been brought into working relation with the underside end 38 of ridge 36, in a manner similar to the manner of operation of the hand tool of my said U.S. Pat. No. 3,890,912 to complete opening of the can.

Turning of knob 138 to loosen the grip of the head assembly 12 on the can components involved permit ready removal of the device 10 from the can.

When the ridge 33 has been fully separated, the can lid can be easily removed from the can side wall.

Alternately, the can seam can be unfolded approximately about one-half of the can ridge circumference, and then the tool of my said U.S. Pat. No. 3,890,912 applied to the can in a manner described in said patent to pry or free the free edging of the can lid free of the can body.

Left hand operation of opener is the same, with hand crank 27 rotated in the opposite direction and working edge 101 employed instead of edge 100, as well as the alternate guide 180, in a manner similar to that described.

The can opener 10A is applied to the can in a similar manner, except that since it is not journaled in a stationary staff or post, the head assembly 12A is moved about the can ridge 33 as it unfolds the can ridge, rather than the can 20 being rotated by the head assembly 12A. Assuming that the opener 10A has been applied to the can ridge 33 as indicated, and is positioned as shown in FIG. 12 to snug wedging disc rim 104 between the cam ridge 33 and the can side surface 30 in the manner indicated in FIGS. 5 and 12, crank arm 27 is swung to move head assembly 12A between and through the positions of FIGS. 5 and 11. With this embodiment it is preferable at this point to then swing crank arm downwardly to approximately the position of FIG. 6, and rotate the can 20 counterclockwise (of FIG. 12) to advance the working edge 100 to a new position for repeating the ridge unfolding stroke just described with overlap into the can ridge length just unfolded. This manner of operation is continued to complete the unfolding of the can ridge, as desired.

Figure 15:
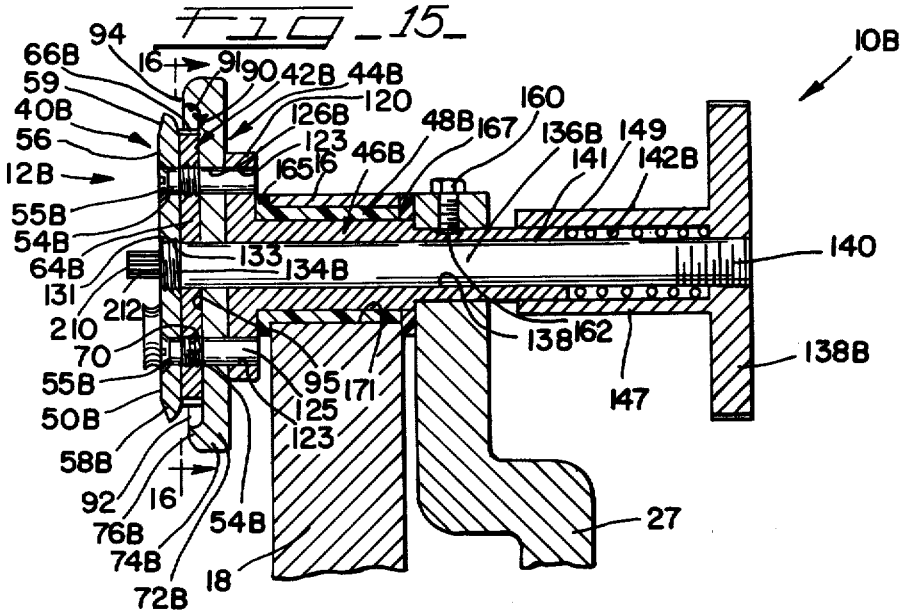
FIG. 15 is a view similar to that of FIG. 3 illustrating a simplified and preferred embodiment of the invention.
Figure 16:
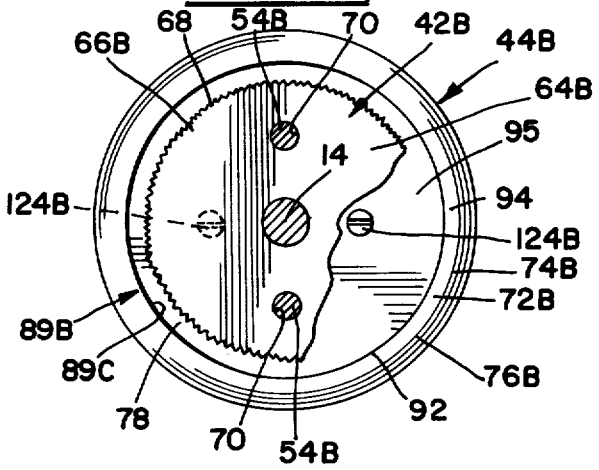
FIG. 16 is a view similar to that of FIG. 4, taken along line 16—16 of FIG. 15, with parts shown in section and broken away.
Figure 17:
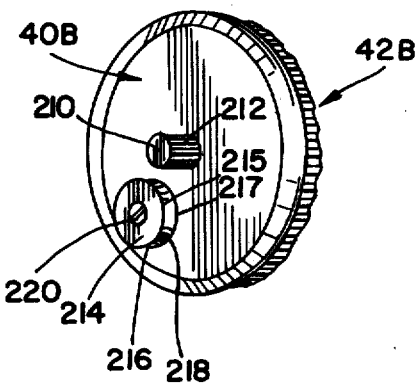
FIG. 17 is a perspective view of the clamping disc of the opener head assembly as viewed in FIG. 19, illustrating an auxiliary can ridge indenting device associated therewith that may be employed in connection with the embodiment of FIGS. 15–22 to form an initial outward indentation in the can ridge to be separated in opening the can.
Figure 18:
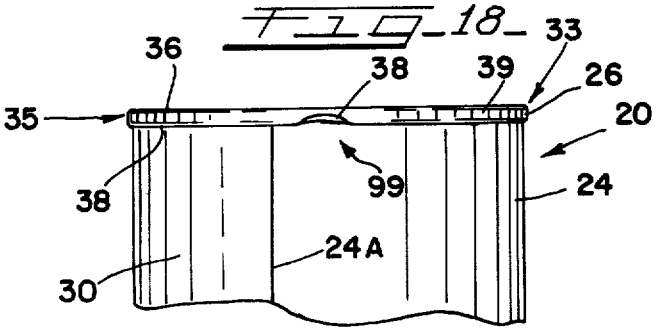
FIG. 18 is a large scale diagrammatic view of an end of a can to be opened utilizing the embodiment of FIGS. 15–22, showing the seam side of the can and the preferred location of the indicated can ridge indentation with respect thereto.
Figure 19:
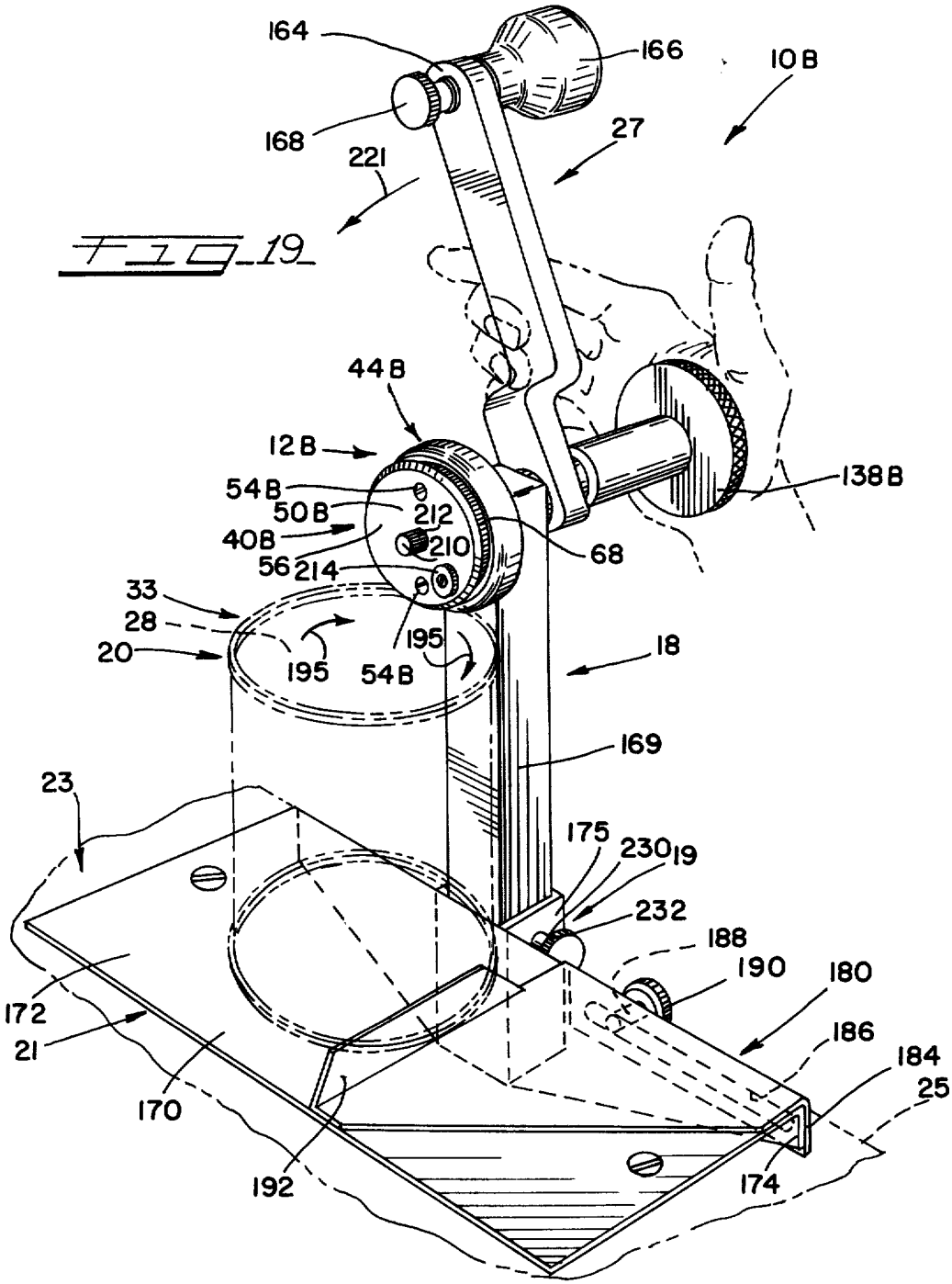
FIG. 19 is a view similar to that of FIG. 1, but illustrating the utilization of the embodiment of FIGS. 15–22.

Referring now to FIGS. 15–22, reference numeral 10B of FIGS. 15 and 19 generally indicates the preferred embodiment of the invention which generally comprises a can opener head assembly 12B journaled for rotation about horizontal axis 14 at the upper end 16 of mounting staff or post 18 that is slidably received in support bracket 19 that is suitably affixed to platform 21 that is in turn suitably secured to a suitable horizontal support 23, such as a table or the like, along one side edge 25 of same, as in the arrangement of opener 10.

In accordance with the opener 10B, the head assembly 12B is rotated about axis 14, in the form shown, by employing hand lever 27, to open conventional containers 20.

Following the principles of this invention, the can opener 10B is arranged to cooperate with the can ridge 33, and specifically with the upper or upwardly extending can ridge 33, when a can is placed upright on a supporting surface, for the purpose of deseaming or unfolding same, about the circumference of the can, in the manner indicated in FIGS. 19 through 22, to open the can without penetrating the can, and without cutting the can components.

Figure 22:
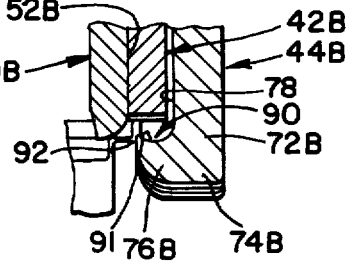

Referring now more specifically to FIG. 15, the can opener head assembly 12B comprises a clamping disc 40B, a traction disc 42B and a wedge disc 44B assembled in the manner indicated in FIG. 15, for operation by hand lever 27 on application of head assembly 12B to the upwardly disposed ridge 33 of a can 20 (see FIG. 19), to unfold the can upwardly directed ridge 33 from the can sealing relation of FIG. 14 to the unfolded relation illustrated by FIG. 22, circumferentially of ridge 33, whereby the upper can end or closure 28 may be readily removed from the can 20 to expose its contents.

In the embodiment of FIGS. 15–22, the head assembly 12B is secured to hub 46B that is in turn received in suitable antifriction sleeve 48B suitably mounted at the upper end 16 of mounting staff 18. Hub 46B extends through the staff or post 18 for keying connection to hand lever 27 whereby the head assembly 12 is rotated about axis 14.

The mounting staff 18 is slidably mounted for movement longitudinally thereof in the bracket 19, as in the case of opener 10. A can 20 to be opened is placed in the operating position indicated at FIG. 19 after the head assembly 12 is raised sufficiently to permit this, and the head assembly 12 is lowered for action on the uperwardly extending can ridge 33, as will be hereinafter described to permit removal of the container end closure or "lid" 28.

The clamping disc 40B of head assembly 12B comprises the disc member 50B that has the traction disc 42B suitably affixed to its side 52B; in the head assembly 12B this is done by employing screws 54B applied from the other side 56 of same that threadedly engage traction disc 42B and have heads 55B that hold member 50B to disc 42B. The disc member 50B is proportioned to define a rim portion 58B that projects beyond the traction disc 42B as indicated in FIG. 15, with the disc member rim portion 58B on its side 52B defining a smoothly and spherically contoured camming surface 60 for clamping engagement with the inner side wall 37 of the can ridge 33, and adjacent its end 36. The side 56 of member 50B about its rim portion 58B is beveled as at 59 for fitting into the narrow groove that is defined by aerosol can tops (about the inner side 37 of the can top ridge 33); bevel 59 may be omitted where application to aerosol cans is not desired.

The traction disc 42B comprises disc member 64B having its periphery 66B knurled as indicated at 68 for tractional riding on the upwardly directed end 36 of the can ridge 33 when the opener 10B is operating on the can ridge 33. Disc member 64B is formed with suitable threaded screw holes 70 for threadedly receiving the screws 54B.

The wedge disc 44B is of special significance and comprises disc member 72B which has its rim portion 74B shaped to define the laterally projecting circular ledge 76B on the side 78 of same. The ledge 76B, in accordance with this embodiment of the invention, is continuous and uninterrupted thereabout (see FIG. 16).

The ledge 76B defines thereabout concave circular working edge 90 having concave working surfacing 91 that is concave transversely of the disc member 72B as well as in the plane of ledge 76B, which edge 90 merges into the marginal concavely arcuate wedging rim 92 that is in substantial coplanar relation with the side surfacing 94 of the ledge 76B.

The ledge 76B, its edge 90, and its wedging rim 92 are in concentric relation with the disc member 72B and about axis 14. Surfacing 91 defines trough 93.

The ledge 76B of wedge disc 44B defines recess 95 in which and within which the traction disc 42B is received and aligned in the operative relation of the head 12B, with the discs 42B and 44B being normally disposed in concentric coaxial relation about axis 14 in accordance with the invention.

Figure 20:
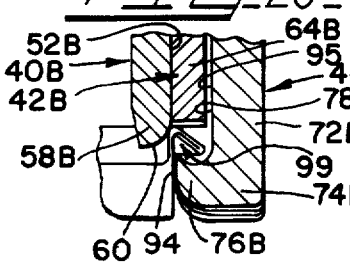
FIGS. 20–22 are similar to FIGS. 7, 9, and 11, respectively, illustrating consecutive stages in the can ridge unfolding action involved in utilizing the embodiment of FIGS. 15–22.
Figure 21:
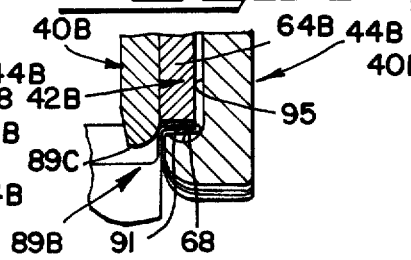

The working edge 90 thus forms a continuous marginal grooved edging 90B with a sharply angled rimming 89C along the edge 76B that effects the aforementioned unfolding action on the can ridge 33 that is indicated in FIGS. 20–22, after the formation of a preliminary outward indentation 99 in the ridge 33, as will be described hereinafter.

Another aspect of the opener 10B is that the head assembly 12 is arranged for separating of the clamping disc 40B (and the traction disc 42B carried by same), from the wedge disc 44B to receive the can ridge therebetween, and in particular, the portion of the can ridge formed with the indentation 99, to apply the opener 10B in operative relation to the can ridge 33. This also provides for accommodating of can ridges 33 of varient sizes (in diameter and thickness) and for clamping of the head assembly 12 in its operating position.

In the opener 10B, this arrangement comprises the hub 46B being flanged as at 120 and formed with openings 123 that are located to slidably receive unthreaded extensions 125 of screws 54B that also similarly extend through the disc 44B in the manner indicated in FIG. 15. Thus, the extensions 125 are received through the openings 126B of the wedge disc 44, with extensions 125 being freely slidable relative to the hub flange 120 and wedge disc 44. The wedge disc 44B is secured to the hub flange 120 by suitable screws 124B threadedly received in suitable threaded openings (not shown) formed in hub flange 120, spaced circumferentially from the location of screws 54B (see FIG. 16).

The clamping disc 40B is formed with a central opening 131 internally threaded as at 133 to fixedly receive the threaded end portion 134B of shaft 136B, which shaft extends through the bore 138 of the hub 46B and has adjustment knob 138B threadedly mounted on its threaded end 140. Shaft 136B should be suitably fixed against removal from disc 40B, as by employing jam fitting, a suitable bonding material, or the like.

Received about the shaft 136B and interposed between the knob 138B and the end 149 of hub 46 is compression spring 142B which biases clamping disc 40B toward hub flange 120 and the parts secured to it, which include in the present embodiment the wedge disc 44B that is held in place against the hub flange 120 by the screws 124B. Knob 138B has a sleeve portion 147 which is in telescoping relation with the end portion 149 of hub 46B against which spring 142B is received, to cover spring 142B from exposure.

In the form shown, the crank arm 27 is equipped with suitable set screw 160 which is seated in recess 162 formed in hub 46B to key the crank arm 27 to the hub 46B. Crank arm 27 at its crank end 164 has hand gripping knob 166 suitably secured thereto by having a suitable pin (not shown) extending therethrough and through crank arm 27 and held in place by suitable lock nut 168. Bearing 48B is flanged as at 165 and bearing disc 167 is employed, to provide antifriction means between the staff 18, hub flange 120, and crank arm 27. Bearings 48 and 167 may be formed from Teflon or the like.

The staff or post 18 in the form of FIGS. 15–22 is an elongate bar 169 proportioned for close fitting free sliding engagement within bracket 19, and defining bore 171 that receives bearing 48B.

Platform 21 of opener 10B comprises angle plate 170 defining a planar smooth upper surfacing 172 and downwardly turned edge portion 174 to which bracket 19 is suitably affixed, as by employing welding. Bracket 19 is a channel member 175 proportioned to closely receive the staff 18, in the illustrated opener 10, while permitting free sliding movement under gravity. The plate 170 is shown affixed to support 25 by a pair of spaced apart depending screws 176 which have their heads shaped so that their top surfaces are no higher than the level of surface 172.

Further in accordance with the invention, the platform 21 is equipped with adjustably mounted can guide member 180 in the form of angle plate member 182 having angled edge portion 184 slotted as at 186 to receive threaded stud 188 that is affixed to the platform angle side edge 174. Stud 188 receives threaded knob 190 for clamping the can guide 180 in a desired position of adjustment. The can guide 180 includes upwardly extending flange 192 that is to engage the side of the can when the opener 10 is operated, as will be described hereinafter.

Platform 21 as shown in FIG. 19 is arranged for right hand operation of head 12. For left hand operation of head 12, a similar platform 21 on the side at the upper portion of FIG. 1 may be provided (not shown) with a second guide member 180 and associated parts arranged to guide the can from upper side of FIG. 19, as described in connection with FIG. 1.

A special feature of the opener 10B is that the head assembly 12B is equipped to provide the initial can ridge indentation 99 that has been referred to in connection with the showing of FIGS. 18 and 20. While this indentation may be made utilizing the hand opener described in my above referred to U.S. Pat. No. 3,980,912, for this purpose the shaft 136B has a projecting end portion 210 having its side surfacing knurled as at 212. In addition, the clamping disc 40B has fixed to same to one side of the location of the shaft 136B a wedge disc 214 having its marginal rim 216 formed to define grooved working edge 218 (see FIG. 17) that extends 360 degrees about the disc 214 and is proportioned to define rim edges 215 and 217 disposed on either side of disc roller. Disc 214 is suitably fixed on clamping disc 40B utilizing mounting screw 220 or the like and located thereon to have the positional relationship to hand lever 27 that is indicated in FIG. 19. The relation of parts involved is that the disc working edge 218 is comparable to the edge 17 of the hand tool of my said U.S. Pat. No. 3,980,912, and the knurled shaft end portion 210 is comparable to the fulcrum 19, of my said U.S. Pat. No. 3,890,912, with edge 218 and fulcrum 210 being of 360 degree circular shaping. The disc rim edge 215 is thus comparable to the rim 60 of my said U.S. Pat. No. 3,890,912 and has the wedge shape contemplated by said patent.

In accordance with the embodiment of FIGS. 15–22, the bracket 19 threadedly mounts a threaded stud 230 that is keyed thereto knob 232, for turning same to set the stud 230 against the bar 169 to set the bar 169 so as to dispose the head assembly 12B and associated parts at a desired position of operation above the platform 21.

The head assembly 12B and associated parts may be modified as suggested by the embodiment of FIGS. 12 and 13 to provide an opener in which the head assembly 12B is not journalled for operation about a stationary axis coincident with the axis 14, but rather the hand crank 27 is swung about axis 14 to move the opener about the can ridge 33.

The opener 10B in its staff mounted embodiment is preferably utilized in accordance with the invention to unfold the ridge 33 of the can 20 in the following manner:

It is assumed that the opener 10B and associated parts are assembled and mounted as indicated in FIGS. 15 and 19, except that the can guide 180 is moved to one side (toward the observer), so as to be out of the way for initial processing of the can.

The can 20 to be opened is selected, and the can is oriented to dispose the can end to be opened at the upper end of the can. The first step to be taken is to form the initial indentation 99 in the can ridge 33 in question, and this may be done in several ways.

One way is to employ the hand tool of my said U.S. Pat. No. 3,890,912 utilizing the procedure described in the paragraph bridging columns 4 and 5, and the second and third paragraphs of column 5, of said patent. In so doing, the indentation 99 that is formed should be located to the right of the can side wall joint 24A, for best results, approximately as shown in FIG. 18 (for right hand operation of opener 10B). This may be done by placing the lower end of the can on platform 21 or elsewhere on support 23, as may be convenient for using the hand tool of my said U.S. Pat. No. 3,890,912.

Another way is to employ the hand tool of my U.S. Pat. No. 3,366,085, following the disclosure of that patent.

Alternatedly, the same indentation may be formed using the opener 10B, and to achieve this, the can to be opened is placed on the platform 21 at a sufficiently spaced position relative to the staff 18 so that (assuming threaded stud 230 is free of staff 18) the head assembly 12B may be rested on the can ridge 35 with the knurled end portion 210 of shaft 136B engaging the can ridge upper end 36. The crank arm 27 is moved to an elevated position approximating that shown in FIG. 19, and the can shifted as needed relative to head assembly 12B, to bring the disc 214, and specifically its working edge 218 rim 215, in working engagement with the can ridge end 38, at the location of the indented indentation 99 that is illustrated in FIG. 18. This seats the disc working edge 218 against end 38 of the can ridge, with marginal rim 215 disposed between the can ridge end 38 and the can side wall surface 30. The operator then holds the can 20 against the platform 21 with his left hand and swings the handle 27 downwardly as needed to form the indentation 99.

The indentation 99 having been formed, the can 20 is now ready for application to the basic ridge unfolding components of head assembly 12B. Assuming that the threaded stud 230 is free of staff 18, the operator grasps the opener 10B with his right hand in the manner indicated in FIG. 19, so that the palm of his hand engages knob 138B and his fingers reach behind the crank arm 27, so that the knob 138B may be pressed toward the handle 27 against the biasing action of spring 142B to move the shaft 136B to the right of FIGS. 15 and 19 so as to extend or dispose the clamping disc 40B, and the traction disc 42B carried thereby, away from the wedge disc 44B a sufficient amount so that the can ridge 33 at the upper end of the can 20, and specifically the portion of the ridge 33 bearing the indentation 99, may be easily applied between the clamping disc 40B and wedge disc 44B for unfolding purposes, with the traction disc 42B resting on the upper end 36 of the can ridge 33 in question. For this purpose, it is convenient to position the handle 27 at approximately the one o'clock position relative to the staff 18, the opener parts involved are held so that the clamping disc 40B is held sufficiently spaced from the wedge disc 44B to permit free rotational adjustment of the can 20 (by the operator using his left hand) relative to the head assembly 12 whereby the indentation 99 may be centered on the staff 18. On release of the knob 138B, the portion of the ridge 33 bearing the indentation 99 should be gripped in the manner indicated in FIG. 20, with the traction disc 42B resting on the upper end 36 of the can ridge.

The release of the knob 138B brings the clamping disc 40B, under the biasing action of spring 142B, into clamping relation with the can ridge so that the can ridge is now clamped between the clamping disc 40B and the wedge disc 44B. The clamping discs 40B will now engage the can ridge 33 at the can ridge side wall 3 at two spaced apart positions with which indentation 99 is centered, and the handle 27 will be held in its indicated one o'clock position. The threaded stud 230 is now tightened against staff 18 to hold the head assembly 12B against vertical movement as the head assembly 12B is operated (as is about to be described), and the can guide 180 is shifted to bring its guide flange 192 into engagement with the side of the can and its knob 190 tightened to lock the can guide in this position.

The handle 166 of the crank arm 27 is then grasped by the operator with his right hand and turned about the axis 14, in a clockwise direction from the standpoint of the operator facing the opener in the showing of FIG. 19, as indicated by arrow 221. For this purpose the operator uses his right hand to swing the crank arm 27 and his left hand to gently hold the can 20 in place. The crank arm is swung smoothly downwardly and then upwardly about the axis 14 during the course of which the can is rotated in the direction of the arrow 195, by the rotating action of the traction disc 42B, and the can ridge flange structure 35 is swung through the positions of FIGS. 21 and 22, so that the can ridge unfolding action proceeds longitudinally of the flange structure 35.

As the swinging movement of the crank arm 27 is instituted, the working edge 90 of the wedge disc 44B effects a camming action on the outwardly bent or indented portion of the can ridge flange structure defining the ridge indentation 99, with the working edge 90 bending the can ridge flange structure 35 along the length of same in a progressive manner, between the positions of FIGS. 20 and 22 as the can is moved about its axis under the action of traction disc 42B. The end 38 of the can ridge structure being caught in the trough 93 defined by the edge 90, and the can rotational movement effected by the rotation of the traction disc 42B, effect the continuous camming action of the can ridge that is involved about the circumference of the can ridge that is to be unfolded.

In a preferred manner of operation, the can end 28 is preferably not completely separated from the can side wall 24, but rather the separation is made around the margin of the can ridge to the point adjacent the left hand side of the can side wall joint 24A (as viewed in FIG. 18) comparable to the spacing of the preliminary indentation 99 therefrom, so that the can end 28 and the can side wall 24 will have a limited amount of attachment. The can end can then be readily separated from the can side wall by grasping the freed can end rim 26 at location opposite the can side wall joint 24A, lifting the can end upwardly.

Alternately, however, the crank arm 27 may be rotated to rotate the can in excess of 360 degrees of movement so that the can end 28 is fully separated from the can side wall 24. When this is done, care must be taken as the portion of the can ridge that is aligned with the can side wall joint line 24 passes through the opener as there may be some interference at this point due to the way that cans are conventionally made. It is for this purpose that the recommended procedure is to leave the can end joined to the can side wall across the can side wall joint 24A.

Left hand operation of the opener would be in the same manner, with the platform 21 being equipped for left hand operation as indicated in FIG. 1 and the hand crank 27 being rotated in the opposite direction; for this purpose the preliminary indentation 99 is provided at the left hand side of the can side wall seam 24A instead of on the right hand side.

It is to be noted that the extensions 125 of screws 54B have lost motion relation to hub 46B and wedge disc 44B, thus permitting the clamping disc 40B and traction disc 42B to be separated from wedge disc 44B in the manner indicated, in applying the head assembly 12B to the can ridge 33 to be unfolded. The extensions 125 also key clamping disc 40B and traction disc 42B to hub 46B for rotation therewith under the swinging action of crank 27.

The basic operative components of the head assemblies 12, 12A, and 12B, namely the clamping discs, the traction discs, and the wedge discs, may be formed from suitable tool steel. Bushings 48, 48A and 48B and associated antifriction discs 167 are formed from Teflon, nylon, or the like.

The remainder of the components may be formed from any suitable metallic or non-metallic substances.

The invention eliminates guesswork in applying the working components of the tool to the can ridge 33. The can ridge becomes gripped between the camming surface of the clamping disc and the side surface 94 of the wedge disc, with the traction disc riding on the can ridge, whereby relative movement of the can ridge is in guided relation between the clamping disc and the wedge disc of the head assemblies 12, 12A and 12B. The bending of the can ridge flange structure 35, starting from the initial or indentation notch formed between same and the can side wall 30, proceeds in a progressive continuous manner as the head assembly rotates relative to the can ridge to effect a uniform smooth bending of the ridge flange structure to the positioning indicated by FIGS. 11 and 22 about the path of movement relative to the can ridge that is followed by the opener head assembly.

While size, in terms of diameter and circumference of the head assembly, is optional, a head assembly in which the wedge disc has an outer diameter of approximately 2½ inches will provide for opening cans of ordinary size with as little as one and one half strokes or revolutions to perhaps five, depending on the can size. Head assemblies of larger diameter will not accommodate the smaller sized cans due to the short radius of the can ridge 33.

It will be noted that the wedging disc working edges 90, 100, and 101 are of concavely curved troughed or grooved configuration transversely thereof and the wedge discs involved, whereby the wedging and bending actions on the can ridge 33 that have been disclosed are facilitated.

While hand operated versions of the can opener arrangement of this invention have been illustrated, it will be appreciated that the opener head assemblies herein disclosed can be readily motorized by suitably coupling hubs 46, 46A and 46B to a driving motor which preferably is reversibly operable.

The surfacing 172 of platform 21 may be provided with suitable graduation indicia for setting the can guide members 180 at the correct position for standard sized cans.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A can opener of the type adapted to open cans by unfolding the can ridge that is formed at one end of the can by folding the end rims of the can end closure and can side wall against the side of the can to define one ridge edge that projects away from the can, a second opposing ridge edge that lies about the can side wall, and a composite flange structure separating said ridge ends that lies about the can side wall in juxtaposition therewith and defines inner and outer ridge side wall sides in circumambient relation about the can ridge, said opener comprising:

a clamping disc, a traction disc, and a wedge disc in coaxial relation about a common rotational axis, said traction disc being interposed between one side of said clamping disc and one side of said wedge disc, said traction disc having its periphery knurled for riding on the can said one ridge edge in the operative position of said opener with said clamping disc one side facing the ridge inner wall surface and the wedge disc one side facing the ridge outer wall surface, said clamping disc being proportioned to define a rim portion projecting radially thereof beyond said traction disc periphery and having said rim portion thereof on said one side thereof smoothly contoured for camming engagement with the can ridge inner side, and means for rotating said discs about said axis to roll said traction disc along the can ridge one edge in the direction to roll said wedge disc wedging rim in wedging camming relation against the can ridge second edge for swinging the can ridge flange structure about the can ridge one edge and away from the can side wall, as said discs roll along the can ridge, to separate the can end rim from the can side wall rim.

2. The opener set forth in claim 1 wherein:

said means for rotating said discs comprises:

a drive member keyed to said keying means and disposed for actuating movement about said axis, and means for moving said drive member about said axis.

3. The opener set forth in claim 1 wherein:

said means for rotating said discs comprises:

a hub keyed to said keying means and disposed on the other side of said wedge disc in coaxial relation with said axis, and hand crank means keyed to said hub for swinging same about said axis.

4. The opener set forth in claim 3 wherein said clamping means comprises:

a stud secured to said clamping disc and extending through said traction disc, said wedge disc, and said hub in coaxial relation with said axis, said wedge disc being proportioned to define a rim portion projecting radially thereof beyond said traction disc periphery, said wedge disc rim portion on said one side of said wedge disc defining a circumferential ledge thereabout defining a recess in which said traction disc is received and an outer side surface that faces in the direction of said clamping disc, said wedge disc ledge defining about its inner side an inner working edge that is concentric with said wedge disc, said wedge disc ledge working edge being concavely curved about said disc ledge and forming therealong a wedging rim that is concentric with said wedge disc, with said wedging rim being substantially coplanar with said wedge disc ledge outer side surface, means for keying said discs together for simultaneous rotational movement about said axis, means for separating said clamping and wedge discs to receive the can ridge flange structure therebetween when said opener is in its said operative position and disposed to present said wedge disc inner working edge wedging rim for wedging against the can ridge second edge and the can side wall, means for releasably clamping said clamping disc rim against the can ridge inner side, said stud being movable axially thereof relative to said wedge disc, and means for moving said stud axially thereof to close the spacing between said clamping disc rim portion and said wedge disc wedging rim for clamping said clamping disc rim portion against the can ridge inner side.

5. The opener set forth in claim 4 wherein said keying means comprises:

pin means keyed to said hub and extending through said discs, said wedge disc being fixed to said hub to form one clamping member, and said traction disc being fixed to said clamping disc to form the other clamping member, said pin means being in lost motion relation to one of said clamping members.

6. The opener set forth in claim 5 including:

resilient biasing means for biasing said stud for movement axially thereof and comprising:

a compression spring encircling said stud.

7. The opener set forth in claim 3 wherein:

said hub is journalled in a vertically adjustable standard, and including means for mounting said standard in an upright position for free vertical movement only, whereby swinging of said hand crank means about said axis rotates said discs about said axis to roll said traction disc along said one ridge edge of the can.

8. The opener set forth in claim 7 wherein said mounting means comprises:

a platform having a smooth upwardly facing surface, means for fixing said platform in a stationary position with said platform surface horizontally disposed, said platform surface serving as a rest on which a can to be opened is disposed for resting of said traction disc on the upwardly extending ridge of said one edge, whereby on said swinging of said hand crank means the can rotates relative to the platform surfaces as said discs roll along the can ridge.

9. The opener set forth in claim 3 wherein:

said hub is free of journaling, and said discs roll along the can ridge on swinging movement of said hand crank means about said axis.

10. The opener set forth in claim 1 including:

means for forming an initial outwardly directed indentation in the can ridge flange structure at the second edge of same prior to the said opener being disposed in said operative position thereof for designating the portion of the can ridge flange structure to be received between said clamping and wedging discs, whereby when said rotating means rotates said discs in said direction, said wedging rim engages said can ridge flange structure indentation to initiate and continue the wedging camming relation of said wedge disc wedging rim for separation of the can end rim from the can side wall rim with continuous movement of said rotating means in said direction for the length of separation desired about said can ridge.

11. The opener set forth in claim 10 wherein:

said wedge disc ledge is continuous and uninterrupted about said wedge disc rim portion.

12. The opener set forth in claim 3 wherein:

said wedge disc ledge is continuous and uninterrupted about said wedge disc rim portion, and including:

means for forming an initial outwardly directed indentation in the can ridge flange structure at the second edge of same prior to the said opener being disposed in said operative position thereof for designating the portion of the can ridge flange structure to be received between said clamping and wedging discs, whereby when said rotating means rotates said discs in said direction, said wedging rim engages said can ridge flange structure indentation to initiate and continue the wedging camming relation of said wedge disc wedging rim for separation of the can end rim from the can side wall rim with continuous movement of said rotating means in said direction for the length of separation desired about said can ridge.

13. The opener set forth in claim 10 wherein:

said means for rotating said discs comprises:

a hub keyed to said keying means and disposed on the other side of said wedge disc in coaxial relation with said axis, hand crank means keyed to said hub for swinging same about said axis, said clamping means comprising:

a stud secured to said clamping disc and extending through said traction disc, said wedge disc, and said hub in coaxial rotation with said axis, said stud being movable axially thereof relative to said hub and wedge disc and being secured adjacent one end thereof to said clamping disc, said stud other end a head secured thereto spaced from said hand crank means, and resilient biasing means for yieldably biasing said stud to seat said traction disc against said wedge disc, whereby said hand crank means and said stud head may be gripped by the user to move said stud against said biasing means to separate said traction disc from said wedge disc for forming said separating means, and said biasing means forms said clamping means on release of said hand crank means and said stud head.

14. The opener set forth in claim 13 wherein:

keying means comprises:

pin means fixed to said clamping disc and said traction disc and having lost motion keying relative to said hub through said wedging disc for accommodating said stud movement relative to said hub.

15. The opener set forth in claim 13 wherein:

said resilient biasing means comprises helical spring means encircling said stud and being interposed between said stud head and said hub.

16. The opener set forth in claim 15 wherein:

said head is adjustably mounted on said stud for adjusting said biasing means.

17. The opener set forth in claim 13 wherein:

said hub being journaled in a vertically adjustable standard, and including means for mounting said standard in an upright position for free vertical movement only, a platform having a smooth upwardly facing surface, means for fixing said platform in a stationary position with said platform surface horizontally disposed, said platform surface serving as a rest on which a can to be opened is disposed for resting of said traction disc on the upwardly extending ridge of said one edge when said opener is in said operative position, whereby on said swinging of said hand crank means the can rotates relative to the platform surfaces as said discs roll around the can ridge.

18. The opener set forth in claim 17 including:

means for releasably setting said standard against vertical movement when the opener is in said operative position.

19. The opener set forth in claim 1 wherein:

said wedge disc ledge is interrupted to define a slot therein extending generally radially of said wedge disc, said wedge disc ledge working edge and wedging rim extending thereabout from either end of said slot, with one of said slot ends defining an inceptive working edge that is coplanar with said inner working edge and that arcs convexly crosswise of said one slot end into smooth merger with said working edge, said inceptive working edge forming a wedging rim that is coplanar with and merges into said inner working edge wedging rim and arcs convexly crosswise of said slot one end, said slot being proportioned to receive the can ridge flange structure when said opener is in its said operative position and disposed to present said inceptive working edge wedge rim for wedging between the can ridge second edge and the can side wall, whereby when said discs roll along the can ridge in said direction the wedge disc inceptive working edge wedging rim and said ledge wedging rim are rolled in consecutive wedging camming relation against the can ridge second edge to separate the can end rim from the can side wall rim.

20. The opener set forth in claim 19 wherein:

said means for rotating said discs comprises:

a hub keyed to said keying means and disposed on the other side of said wedge disc in coaxial relation with said axis, and hand crank means keyed to said hub for swinging same about said axis, said clamping means comprising:

a stud anchored in said clamping disc and extending through said traction disc said wedge disc and said hub in coaxial relation with said axis, means for resiliently biasing said clamping disc away from said wedge disc, and means for moving said stud against the action of said biasing means to close the spacing between said clamping disc rim portion and said wedge disc rim portion for clamping said clamping disc rim portion against the can ridge inner side.

21. The opener set forth in claim 20 wherein:

said hub is journaled in a vertically adjustable standard, and including means for mounting said standard in an upright position for free vertical movement only, a platform having a smooth upwardly facing surface, means for fixing said platform in a stationary position with said platform surface horizontally disposed, said platform surface serving as a rest on which a can to be opened is disposed for resting of said traction disc on the upwardly extending ridge of said one edge when said opener is in said operative position, whereby on said swinging of said hand crank means the can rotates relative to the platform surfaces as said discs roll around the can ridge.

22. The opener set forth in claim 19 wherein:

said hub is free of journaling, and said discs roll around the can ridge on swinging movement of said hand crank means about said axis.

* * * * *